US008740718B1

(12) United States Patent
Farris, III et al.

(10) Patent No.: US 8,740,718 B1
(45) Date of Patent: Jun. 3, 2014

(54) GOLF CLUB AIMING SIGHT DEVICE

(71) Applicants: Alex F. Farris, III, Birmingham, AL (US); Gerald M. Walsh, Birmingham, AL (US)

(72) Inventors: Alex F. Farris, III, Birmingham, AL (US); Gerald M. Walsh, Birmingham, AL (US)

( * ) Notice: Subject to any disclaimer, the term of this patent is extended or adjusted under 35 U.S.C. 154(b) by 0 days.

(21) Appl. No.: 14/020,792

(22) Filed: Sep. 7, 2013

(51) Int. Cl.
*A63B 69/36* (2006.01)

(52) U.S. Cl.
USPC ..... 473/252; 473/238

(58) Field of Classification Search
USPC ..... 473/238, 240, 251, 252, 253, 254
See application file for complete search history.

(56) References Cited

U.S. PATENT DOCUMENTS

| | | | | |
|---|---|---|---|---|
| 2,898,109 | A * | 8/1959 | Williams | 473/240 |
| 4,167,268 | A * | 9/1979 | Lorang | 473/238 |
| 4,355,810 | A | 10/1982 | Rydeck | |
| 4,629,193 | A * | 12/1986 | Pierman | 473/254 |
| 4,789,158 | A * | 12/1988 | Chiesa | 473/238 |
| 5,441,273 | A * | 8/1995 | Stormon | 473/251 |
| 5,551,696 | A | 9/1996 | Izett et al. | |
| 6,561,920 | B1 | 5/2003 | Hamilton | |
| 7,429,222 | B2 | 9/2008 | Tolson | |
| 7,850,536 | B1 | 12/2010 | Fitzgerald | |
| 8,088,018 | B2 | 1/2012 | Melville et al. | |
| 2009/0143158 | A1 * | 6/2009 | Fidge | 473/238 |

* cited by examiner

*Primary Examiner* — Nini Legesse
(74) *Attorney, Agent, or Firm* — Gerald M. Walsh

(57) ABSTRACT

A golf club aiming sight device having a clamp portion and a rear sight portion. The rear sight portion has one or more openings to visualize a front sight on a club head of a golf club. The clamp portion provides for the attachment of the golf club aiming sight device to the shaft of the golf club so that the front sight is visually alignable with the opening in the rear sight. The golf club aiming sight device is used to train a user to swing the golf club without bending or rotating the wrists by having the user maintain the front sight visually aligned with the opening in the rear sight while swinging the golf club.

3 Claims, 5 Drawing Sheets

GOLF CLUB AIMING SIGHT DEVICE

FIELD OF THE INVENTION

This invention relates to putters and wedges used in the game of golf and, more specifically, to an aiming sight device which may be used to train and assist a golfer in the development and maintenance of a desirable and repeatable golf swing motivated by the movement of the shoulders while preventing the wrists from bending and from rotating.

BACKGROUND OF THE INVENTION

The ability to putt or chip a golf ball with consistent accuracy flows from the use of the proper form in the golfer's swing. It is preferable, if not essential, for golfers to learn to stroke the golf club by the use of, primarily, their shoulders. Excessive use of the golfer's wrists in the stroke, in many instances, causes the club head to approach and come into contact with the golf ball in a manner which results in pushing, pulling and other undesirable movement or paths as the club head approaches the ball, at impact, and as the golfer follows through. This results from bending (flexion and extension) and rotating (pronation and supination) the wrists. It is, therefore, desirable for beginning or recreational golfers to develop putting and chipping swings primarily driven by movement of the golfer's shoulders in a pendulum motion with little or no motion of the wrists.

In this swing, the shoulders, arms, and hands move back as one integral unit as a triangle. The hands only hold the club and the wrists work as a hinge. In putting or chipping, a golfer uses only his upper extension above the hips. The left chest and shoulder push the club back and then pull the club forward through the ball. The swinging centrifugal force is thus created in the center of the extension. The hands and wrists are pulled through the ball by the centrifugal force like a flailing action. In this one piece swing the path of the club is essentially an arc, because it is motivated by the shoulders and not the hands. On the backswing, the left shoulder starts the club straight back from the ball then the natural turning of the shoulders brings the club inside the target line. On the downswing, the club comes from inside the target line, to straight through the ball area, then back to inside again.

Moving only the shoulders to create the swing is relatively difficult for most beginning or recreational golfers. Minor movements of bending and rotating the hands or wrists are usually not noticed or detectable by these golfers. These minor movements are sufficient to deviate the club face from the proper square (perpendicular) orientation to the target line. What is needed is a device and method to train the golfer to swing the golf club while keeping the wrists still, i.e., no bending or rotation of the wrists.

SUMMARY OF THE INVENTION

This invention is a golf club aiming sight device, having a clamp portion and a rear sight portion, wherein the aiming sight device can be foldable between the clamp portion and the rear sight portion and wherein the length of the rear sight portion can be adjustable. The rear sight portion has one or more openings to visualize a front sight on a club head of a golf club, wherein both the front sight and the opening in the rear sight portion have a triangular shape. In an alternate embodiment the opening in the rear sight portion is a V-notch and the front sight has a triangle-shaped tip. The clamp portion provides for the attachment of the aiming sight device to a shaft of the golf club so that the front sight is visually alignable with the opening in the rear sight, wherein the aiming sight device is rotatable around the shaft and wherein the sight device is movable along the length of the shaft. The sight device will train a user to swing the golf club with the user's shoulders without bending or rotating the wrists as long as the user maintains the front sight visually aligned within the opening in the rear sight while swinging the golf club.

The aiming sight device provides a method of training a golfer to swing a golf club using the shoulders to generate the golf swing without bending or rotating the wrists. The aiming sight device is attached to the shaft of a golf club, such as a putter or chipping wedge, and a front sight is attached to the top surface of the club head of the golf club. The aiming sight device is aligned along the longitudinal axis of the club head. The shaft is moved until there is visual alignment of the front sight in the opening of the rear sight. The golf club is swung in a pendulum-like manner keeping the head centered between the shoulders and keeping the front sight in visual alignment with the opening in the rear sight while swinging the golf club. One can then practice hitting a golf ball with a golf club, such as a putter or chipping wedge, while keeping the front sight in visual alignment with the opening in the rear sight while swinging the golf club.

An advantage of the present invention is an aiming sight device for a golf club that will train a user how to swing a putter or wedge golf club with the shoulders so that the face of the club will be square at impacting the golf ball as it was at addressing the golf ball.

Another advantage is an aiming sight device for a golf club that is easy to install or uninstall on a golf club shaft.

Another advantage is an aiming sight device that is compact and adjustable.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1C:
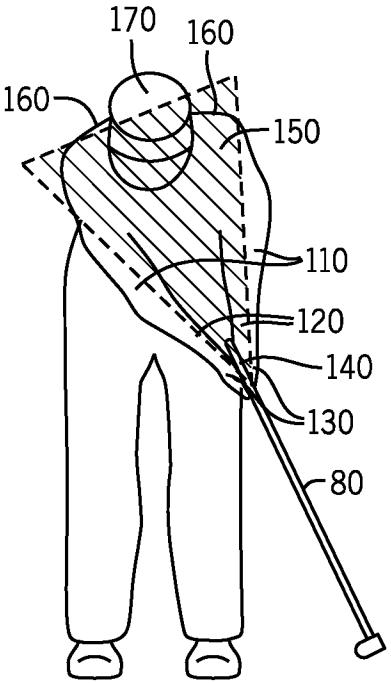
FIGS. 1*a*-1*c* illustrates the shoulder motivated golf swing required for accurate putting and chipping.
Figure 1B:
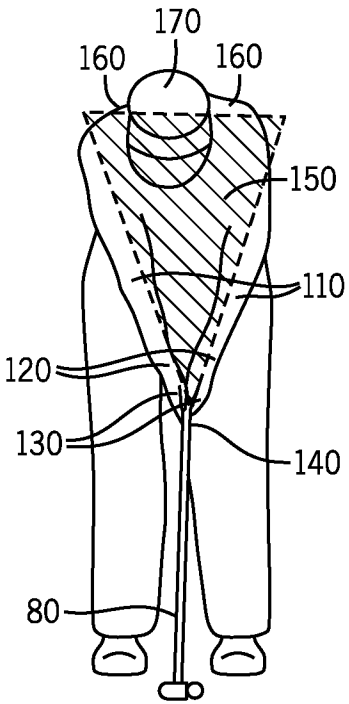
Figure 1A:
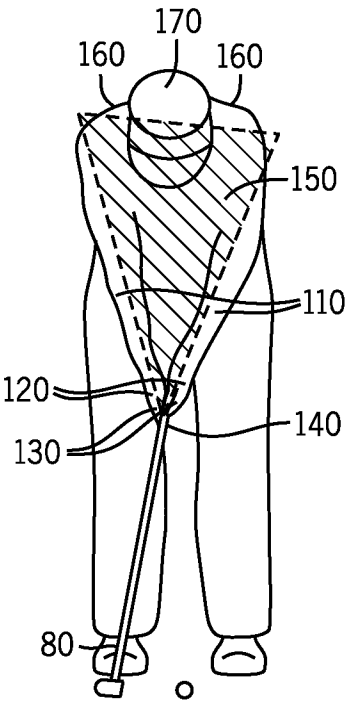

With reference to FIGS. 1*a*-1*c*, the shoulder motivated swing involves keeping the positional relationship between the arms 110, wrists 120, hands 130 and putter 80 constant, thus forming a 'Y' shape 140. In order to hit the ball, the player's shoulders 160 are rotated (or rocked) in a single plane with the player's head 170 being the 'pivot' point. During the whole stroke, from backswing (FIG. 1*a*), to impact (FIG. 1*b*), to follow-through (FIG. 1*c*), the 'Y' shape 140 is kept constant and the player's shoulders 160 are maintained in a single plane. It is also desirable for the player to keep his head 170 over the starting position of the ball during the stroke. The triangle 150 formed by the player's arms 110 and shoulders 160 may be maintained in the same plane as that of the shoulders 160. This shoulder rotation can be used with drivers, irons, woods, wedges, and putters. With putters, for example, a shoulder motivated putting action helps to provide accurate putts because there are as few extension movements as possible.

Figure 2:
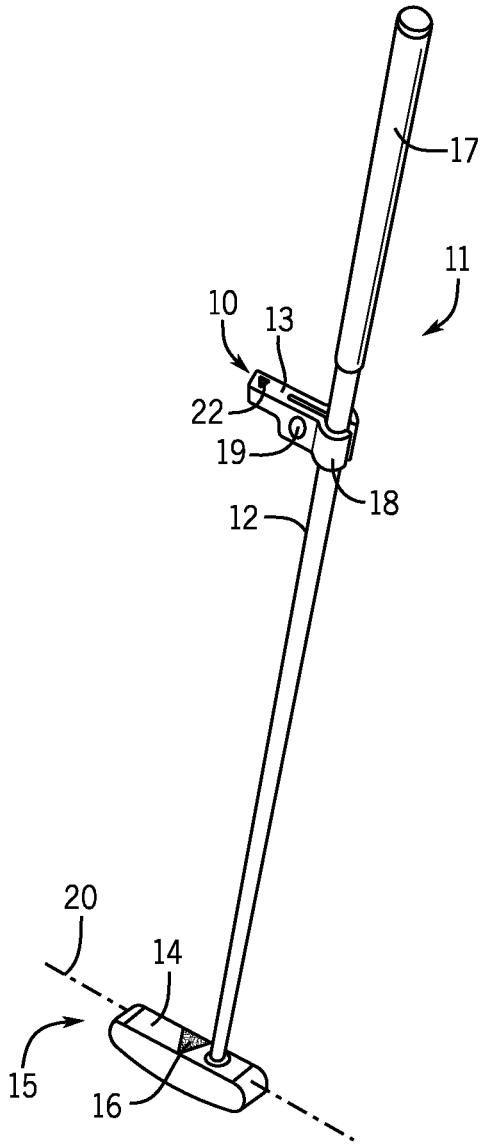
FIG. 2 illustrates the golf club aiming sight device attached to a golf putter.

The golf club aiming sight device of the present invention trains a user to swing the golf club with the shoulders, while keeping the hands and wrists from bending and rotating. FIG. 2 shows the golf club aiming sight device 10 of the present invention attached to the shaft 12 of a putting golf club 11. The aiming sight device 10 has a rear sight portion 13 with an opening 22. The top surface 14 of the putter portion 15 (club head) of putting golf club 11 has a front sight 16 at the center of the putter portion 15. The aiming sight device 10 has a clamp portion 18 attached to the rear site portion 13 and which reversibly attaches to shaft 12 using a bolt 19. The aiming sight device 10 can be positioned anywhere along the shaft 12, preferably near the handle 17. The aiming sight device 10 is aligned over the longitudinal axis 20 of the putter portion 15.

A user grips the handle 17, addresses the ball (or ball position), places his head in a fixed position over the ball (or ball position), looks though the rear sight portion 13, and moves the shaft 12 towards or away from himself until he sees the front sight 16 aligned in the opening 22 of rear sight portion 13. The user can then swing the club forward or backward in a pendulum fashion by rotating his shoulders while keeping the front sight 16 in alignment with the rear sight portion 13. If the user can always see the front sight 16 in the opening 22 of rear sight portion 13 while swinging with the shoulders, then the hands and wrists are not bending or rotating. Thus, the swing is being performed only with the rotation of the shoulders and not by bending or rotating the wrists. The orientation of a club face square to the target line at address will be maintained at impact, thereby producing straight line of travel of the ball along the target line with consistency. This results from a swing that is generated mainly by the rotation of the shoulders. If the hands and wrists bend or rotate, the front sight 16 will not be visible in the opening 22 of rear sight portion 13 and the club face will most likely not be square at impact as it was at address. Thus, the golf club aiming sight device 10 provides a training method for a user to develop a pendulum-type golf swing produced mainly by rotation of the shoulders while preventing the wrists from bending and rotating, as illustrated in FIGS. 1*a*-1*c*. This is accomplished by the user always keeping the front sight 16 visible through the opening 22 of rear sight portion 13 while swinging with the shoulders.

Figure 3:
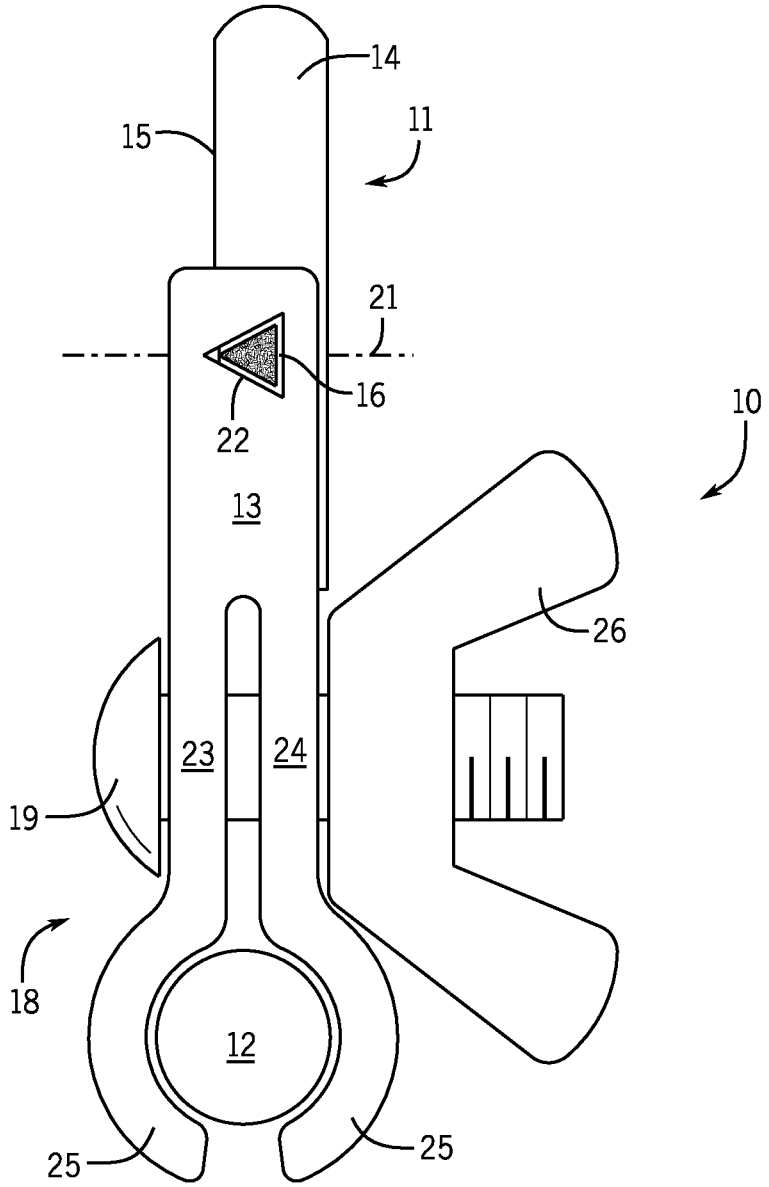
FIG. 3 provides a more detailed illustration of the golf club aiming sight device.

FIG. 3 shows a top view of the golf club aiming sight device 10 attached to the shaft 12 of a putting golf club 11. The aiming sight device 10 is shown positioned over the top surface 14 of the putter portion 15 so that the front sight 16 is visually aligned within the opening 22 in the rear sight portion 13. The front sight 16 on top surface 14 is positioned in the center of the putter portion 15, indicated by the dashed line 21. In this configuration the opening 22 of rear sight portion 13 is shown positioned over the front sight 16 with the front sight 16 centered in the opening 22 of rear sight portion 13. The object of using aiming site device 10 is to keep the front sight 16 visually aligned in the rear sight portion 13, as shown in FIG. 3, while swinging the golf club back and forth in the manner describe for FIGS. 1*a*-1*c*.

Golf club aiming sight device 10 is constructed, preferably, as a clamp portion 18 having a rear sight portion 13 connected thereto. Clamp portion 18 has a pair of arms 23 and 24 with grips 25 at their extremities. The grips 25 are configured to engage shaft 12 to reversibly attach aiming sight device 10 to shaft 12 by methods well known in the art. The arms 23 and 24 may be flexible so they may be spread apart to fit the grips 26 over shaft 12. They may be biased inward to provide attachment by a compression fit. A bolt 19 may be inserted through arms 23 and 24 and a wing nut 26 applied to bolt 19 to compress the grips 25 against the shaft for reversible attachment. Components 19, 23, 24, 25, and 26 form the clamp portion 18. Grips 25 allow rotation of aiming sight device 10 around shaft 12 to align aiming sight device 10 with putter portion 15. They also allow positioning of aiming sight device 10 anywhere along the length of shaft 12 as desired. The opening 22 is located in the rear sight portion 13, preferably near the free end of rear sight portion 13.

The rear sight portion 13 is, preferably, about 1 to 8 inches long and about 0.1 to 0.5 inches thick. The rear sight portion 13 can be in any desired shape. The opening 22 is, preferably, about 0.1 to 0.5 inches wide. The front sight 16 on the top surface of the club head is, preferably, about 0.1 to 0.5 inches wide.

In use, golf club aiming sight device 10 is attached to a shaft 12 of a putter 11 or other golf club by means of the clamp portion 18. The aiming sight device 10 is aligned along the longitudinal axis 20 of the club head. A front sight 16 is placed on top of the club head 15. The head of the user is positioned over the ball position and the shaft 12 is moved until the front sight 16 can be seen in the opening 22 of rear sight portion 13, indicating that the front site 16 is visually aligned with the opening 22. The only way to keep the front sight 16 visually within the opening 22 of rear sight portion 13 while swinging the golf club is to have no bending and no rotation of the wrists. The golf club is swung back and forth by vertical shoulder rotation, for a distance of about 2 or 3 feet on either side of the golf ball position, keeping the front sight 16 visible continuously in the opening 22 of rear sight portion 13 while swinging. This is repeated continuously to train the user to keep his or her wrists still while swing, i.e., no bending and no rotation of the wrists. A golf ball may then be putted or chipped with the golf club by the user, with the user looking only at the front sight 16 in the opening 22 of rear sight portion 13 as the user swings the golf club. If the aiming sight device 10 is properly aligned with the club head and the front sight 16 is continuously seen in the rear sight portion 13 while swinging, the golf ball will travel in a straight line when the user strikes the golf ball with the golf club. Practicing this way with the aiming sight device 10 will train the user to develop a pendulum-like vertical shoulder swing that will allow the user to putt and chip accurately and consistently. This is so because there will be little or no bending and/or rotation of the wrists.

Figure 4:
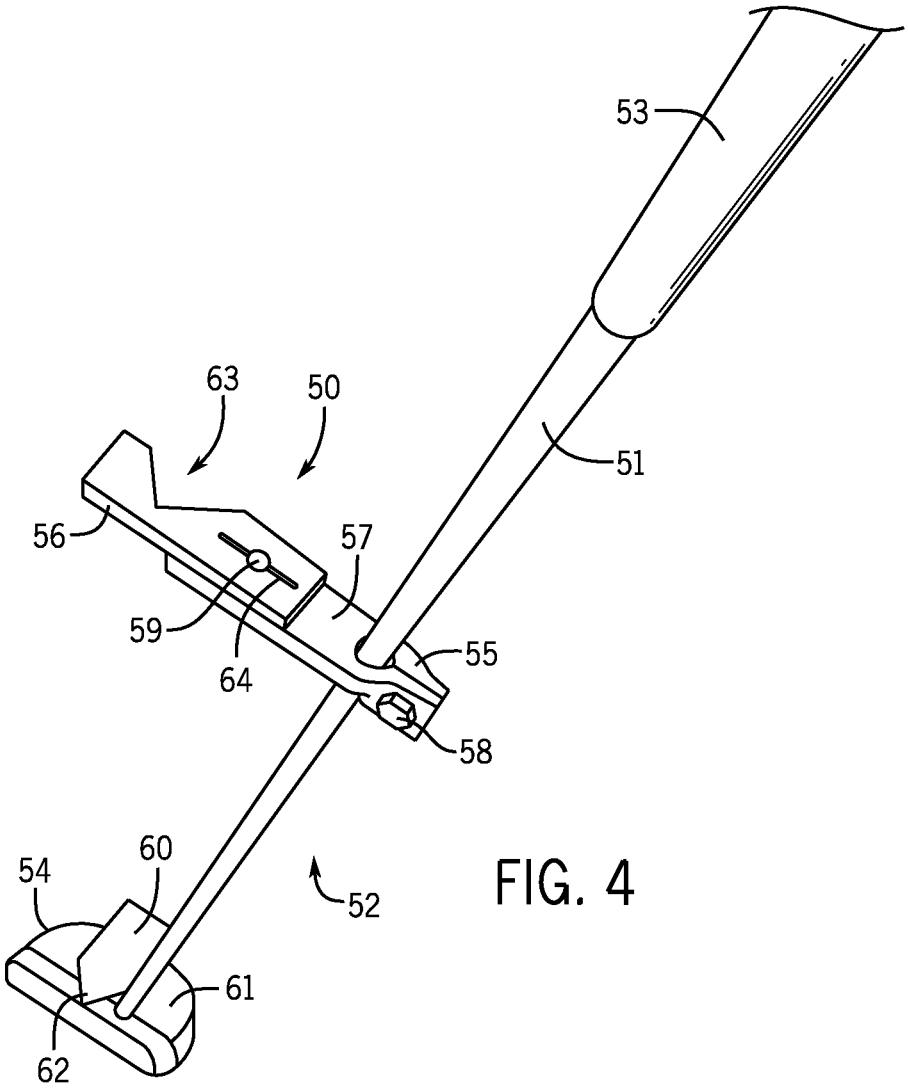
FIG. 4 shows an alternate embodiment of the golf club aiming sight device.

FIG. 4 shows an alternate embodiment of the present invention. Aiming site device 50 is attached to shaft 51 of a putting golf club 52 between the handle 53 and the club head 54. The aiming sight device 50 has a clamp portion 55 and a rear sight portion 56. Clamp portion 55 has a platform 57 to which rear sight portion 56 is slidably and adjustably attached. Bolt 58 attaches the clamp portion 55 to shaft 51. Bolt 59 attaches rear sight portion 56 to platform 57. A front sight 60 is attached to the top surface 61 of club head 54. The front sight has a triangle shaped tip 62 and the opening in the rear sight portion is a V-shaped notch 63. Rear sight portion 56 has a groove 64 through which bolt 59 is inserted. Groove 64 allows rear sight portion 56 to be moved closer to or away from the shaft 51 as desired.

Figure 5:
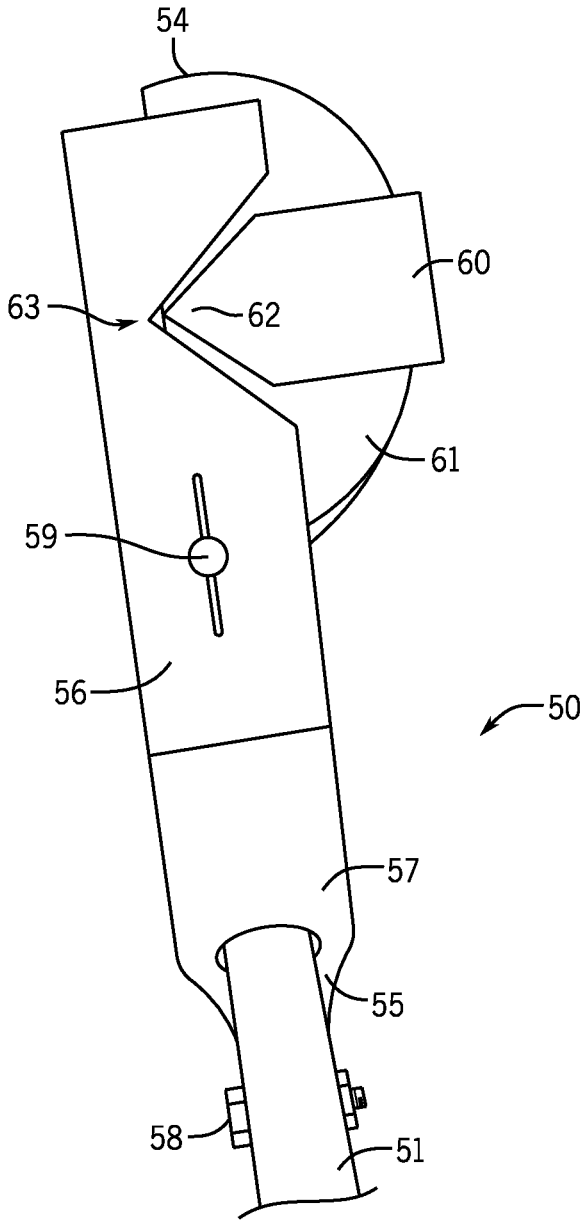
FIG. 5 shows a more detailed illustration of the golf club aiming sight device of FIG. 4.

FIG. 5 shows a top view of the rear sight portion 56 positioned over club head 54. In use, as noted above, the head of the user is positioned over the ball position and the shaft 51 is moved until the triangle shaped tip 62 of front sight 60 can be seen in the V-shaped notch 63 of rear sight portion 56, indicating that the triangle shaped tip 62 is visually aligned with the V-shaped notch 63. The only way to keep the triangle shaped tip 62 visually aligned within the V-shaped notch 63 while swinging the golf club in a pendulum-like manner is to swing the golf club by rotating the shoulders vertically while preventing the hands and wrists from bending and rotating.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the front sight can be any kind of area, place, marker, or shape on the surface of the club head. The front sight can be located anywhere on the club head as desired. The opening of rear sight portion can be of any shape. Any kind of suitable clamp configuration can be used for the clamp portion of the aiming sight device. Many suitable clamps are known in the prior art (for example, see U.S. Pat. Nos. 4,145,054; 4,836,625, and 6,251,025). The aiming sight device can be made of metal, plastic, wood, or a combination thereof. The aiming sight device can be hinged or rotatable between the rear sight portion and clamp portion so that the rear sight portion can be rotated towards the shaft. The rear sight portion can be constructed so that its length is adjustable, it can have any desired shape, and it can have more than one opening. A putter or wedge can be constructed with an aiming sight device built permanently into the shaft. The aiming sight device can be used with any golf club or with any device shaped like a golf club.

It will be understood that various changes in the details, materials, and arrangements of the parts which have been described and illustrated above in order to explain the nature of this invention may be made by those skilled in the art without departing from the principle and scope of the invention as recited in the following claims.

We claim:

1. A golf club aiming sight device, comprising:

a) a clamp portion and a rear sight portion;

b) said rear sight portion having an opening to visualize a front sight on a club head of a golf club, wherein said opening in said rear sight portion has a triangular shape and said front sight has a triangular shape; and c) said clamp portion providing attachment of said golf club aiming sight device to a shaft of said golf club so that said front sight is visually alignable with said opening in said rear sight, wherein said golf club aiming sight device is rotatable around said shaft, wherein said golf club aiming sight device is movable along the length of said shaft, and wherein said golf club aiming sight device will train a user to swing said golf club without bending or rotating the wrists as long as said user maintains said front sight visually aligned with said opening in said rear sight while swinging said golf club.

2. A golf club aiming sight device, comprising:

a) a clamp portion and a rear sight portion;

b) said rear sight portion having an opening to visualize a front sight on a club head of a golf club, wherein said opening in said rear sight portion is a V-notch and said front sight has a triangle-shaped tip; and c) said clamp portion providing attachment of said golf club aiming sight device to a shaft of said golf club so that said front sight is visually alignable with said opening in said rear sight, wherein said golf club aiming sight device is rotatable around said shaft, wherein said golf club aiming sight device is movable along the length of said shaft, and wherein said golf club aiming sight device will train a user to swing said golf club without bending or rotating the wrists as long as said user maintains said front sight visually aligned with said opening in said rear sight while swinging said golf club.

3. A golf club aiming sight device, comprising:

a) a clamp portion and a rear sight portion, wherein said golf club aiming sight device is foldable between said clamp portion and said rear sight portion;

b) said rear sight portion having one or more openings to visualize a front sight on a club head of a golf club, wherein said opening in said rear sight portion has a triangular shape and said front sight has a triangular shape, or said opening in said rear sight portion is a V-notch and said front sight has a triangle-shaped tip; and c) said clamp portion providing attachment of said golf club aiming sight device to a shaft of said golf club so that said front sight is visually alignable with said opening in said rear sight, wherein said golf club aiming sight device is rotatable around said shaft, wherein said golf club aiming sight device is movable along the length of said shaft, wherein the distance of said rear sight portion from said shaft is adjustable when said aiming sight device is attached to said shaft, and wherein said golf club aiming sight device will train a user to swing said golf club without bending or rotating the wrists as long as said user maintains said front sight visually aligned within said opening in said rear sight while swinging said golf club.

* * * * *